US007584917B2

(12) United States Patent
Briggs et al.

(10) Patent No.: US 7,584,917 B2
(45) Date of Patent: Sep. 8, 2009

(54) SEAL FOR COILED SPRING ASSEMBLY

(75) Inventors: Oliver G. Briggs, Jefferson, MA (US); Jeffrey A. Case, East Granby, CT (US); Melissa Cassidy, Newington, CT (US); Lawrence S. Farris, East Granby, CT (US)

(73) Assignee: Alstom Technology Ltd (CH)

( * ) Notice: Subject to any disclaimer, the term of this patent is extended or adjusted under 35 U.S.C. 154(b) by 218 days.

(21) Appl. No.: 11/693,052

(22) Filed: Mar. 29, 2007

(65) Prior Publication Data

US 2008/0237379 A1 Oct. 2, 2008

(51) Int. Cl.
*B02C 15/00* (2006.01)

(52) U.S. Cl. ..... 241/121

(58) Field of Classification Search ..... 241/117–121, 241/293

See application file for complete search history.

(56) References Cited

U.S. PATENT DOCUMENTS 3,465,971 A 9/1969 Dalenberg et al.
4,002,299 A 1/1977 Skalka
4,234,132 A 11/1980 Maliszewski, Jr.
4,706,900 A 11/1987 Prairie et al.
4,759,509 A 7/1988 Prairie
6,061,908 A 5/2000 DeMarey et al.
6,564,727 B1 5/2003 Kmiotek et al.

*Primary Examiner*—Mark Rosenbaum
(74) *Attorney, Agent, or Firm*—Cantor Colburn LLP

(57) ABSTRACT

A coil spring assembly for connection with a separator body to apply a spring force to a grinding roll of a journal assembly to pulverize solid fuel. The coil spring assembly includes: a preload stud having a first end in communication with the journal assembly and an exposed opposite second end extending from the coil spring assembly; a spring adjustment bolt and bearing assembly being fixed relative to the preload stud extending therethrough; and a seal being substantially cylindrical shaped and flexible at least along a central axis thereof. The seal has a first end operably secured to the spring adjustment bolt and bearing assembly and an opposite second end operably secured to the second end of the preload stud thereby sealing a bushing area corresponding to a portion of the preload stud surrounded by the spring adjustment bolt and bearing assembly from ground solid fuel dust and allowing movement of the preload stud at least along the central axis thereof to apply the spring force from the coil spring assembly to the grinding roll.

7 Claims, 3 Drawing Sheets

SEAL FOR COILED SPRING ASSEMBLY

TECHNICAL FIELD

The present invention relates to a seal for a coiled spring assembly for pulverizing a solid fuel, and more particularly, to a spring stud seal for a coiled spring assembly of a mill for pulverizing a solid fuel, such as coal, for example, in a new utility unit application or a retrofit application in an existing utility unit.

BACKGROUND

Pulverizers are well known for the reduction of the particle size of solid fuel to allow for combustion of the solid fuel in a furnace. A pulverizer employs some combination of impact, attrition and crushing to reduce a solid fuel to a particular particle size. Several types of pulverizer mills can be employed for the pulverization of the solid fuel, for example, coal, to a particulate size appropriate for firing in a furnace. These can include ball-tube mills, impact mills, attrition mills, ball race mills, and ring roll or bowl mills. Most typically, however, bowl mills with integral classification equipment are employed for the pulverization of the solid fuel to allow for transport, drying and direct firing of the pulverized fuel entrained in an air stream.

Bowl mills have a grinding ring carried by a rotating bowl. Fixed position rollers are mounted on roller journal assemblies such that the roll face of the rollers are approximately parallel to the inside surface of the grinding ring and define a very small gap therebetween. Pressure for grinding is applied through springs or hydraulic cylinders on the roller journal to crush solid fuel caught between the roll face of the roller and the grinding ring.

An air stream is typically utilized for drying, classification, and transport of the solid fuel through the pulverizer. The air stream employed is typically a portion of the combustion air referred to as the primary air. The primary air is combustion air first directed through a preheater whereby the combustion air is heated with energy recovered from the flue gas of the furnace. A portion of the primary air is then ducted to the pulverizers. In a bowl mill, the primary air is drawn through beneath the bowl of the bowl mill and up past the roller journal assemblies to collect the pulverized solid fuel. The small particles of solid fuel become entrained in the primary air. The air stream containing the solid fuel then passes through a classifier into the outlet of the pulverizer. After passing through the exhauster, the pulverized fuel can be stored, or more typically, is transported to the furnace by the air stream for direct firing.

For example, U.S. Pat. No. 4,706,900 entitled "Retrofitable Coiled Spring System," which issued on Nov. 17, 1987 and which is assigned to the same assignee as the present invention illustrates a prior art form of bowl mill using a coiled spring assembly for applying pressure on the roller journal to crush solid fuel caught between the roll face of the roller and the grinding ring. U.S. Pat. No. 4,706,900 discloses both the nature of the construction and the mode of operation of a bowl mill that is suitable for use for purposes of effecting the pulverization of the coal that is used to fuel a coal-fired steam generator.

The journal loading, which dictates the amount of grinding force that the grinding rolls exert on the coal, as mentioned above has been provided to date either through the use of hydraulic systems or through the use of mechanical springs. One such arrangement of mechanical springs can be found depicted, for example, in U.S. Pat. No. 4,706,900. In accord with a showing contained in this U.S. patent, each grinding roll is urged towards the surface of the grinding table by means of an adjustable spring. To this end, a suitable mechanical coiled spring that possesses desired design characteristics is selected; namely, a spring that is capable of urging the grinding roll toward the grinding table surface in such a manner that the grinding roll exerts a predetermined grinding force on the coal disposed on the table, when the coal is of a predetermined depth on the table.

Although the coiled spring assembly constructed in accordance with the teachings of U.S. Pat. No. 4,706,900 has demonstrated to be operative for the purpose for which it has been designed, a need still exists to improve the coiled spring assembly. More specifically, a spring extension cap is presently incorporated on bowl mill type journal spring assembly to cover a spring stud extending from the coiled spring assembly in order to seal the coiled spring assembly. By sealing the exposed end of the spring assembly that is exposed to atmospheric conditions, the extension cap eliminates a differential pressure across the spring assembly so that solid fuel dust, such as coal dust, for example, cannot flow into a bushing assembly having a bushing which allows the spring stud to extend therethrough and to translate axially with respect to the bushing assembly of the coiled spring assembly.

It is desirable to visually inspect an end of the spring stud to determine the amount of spring movement, which indicates relative journal and grinding roll movement. However, when a spring extension cap is in place, the end of the spring stud cannot be visually inspected without removing the extension cap. Therefore, the extension cap must be removed to monitor spring stud movement, which allows solid fuel coal (e.g., coal dust) to flow into the coiled assembly as a result of the differential pressure across the spring assembly and cause premature failure of the bushing or spring stud.

Therefore, there remains a need for an apparatus and method for sealing a coiled spring assembly, which facilitates inspection of an end of a spring stud extending therefrom to determine an amount of spring movement of the coiled spring assembly.

SUMMARY

According to the aspects illustrated herein, there is provided a mill for pulverizing a solid fuel. The mill includes: a substantially closed separator body; a grinding table rotatably mounted on a shaft in the separator body; a grinding roll rotable via a journal assembly disposed in the separator body, the journal assembly being supported so as to be pivotable and move the grinding roll into and out of engagement with solid fuel disposed on the grinding table; a coil spring assembly connected to the separator body and in communication with the journal assembly to apply a spring force to the grinding roll. The coil spring assembly includes: a preload stud having a first end in communication with the journal assembly and an opposite second end extending from the coil spring assembly and exposed outside of the separator body; a spring adjustment bolt and bearing assembly being fixed relative to the preload stud extending therethrough; and a seal being substantially cylindrical shaped and flexible at least along a central axis thereof, the seal having a first end operably secured to the spring adjustment bolt and bearing assembly and an opposite second end operably secured to the second end of the preload stud thereby sealing a bushing area corresponding to a portion of the preload stud surrounded by the spring adjustment bolt and bearing assembly from ground solid fuel dust and allowing movement of the preload stud at least along the central axis thereof to apply the spring force from the coil spring assembly to the grinding roll.

According to the other aspects illustrated herein, a mechanical coiled spring assembly for a pulverizing mill is disclosed. The mechanical coiled spring assembly includes: a preload stud having an exposed first end and an opposite second end; a first pressure spring seat at the second end of the preload stud, the first pressure spring seat configured to transmit a spring force to an external assembly; a stud bearing housing configured to house at least an intermediate portion of the preload stud, the stud bearing housing configured to be fixedly secured to a bowl mill; a second pressure spring seat having the preload stud slidably extending therethrough, the second pressure spring seat being translatable within the stud bearing housing along an axis defining the preload stud; a pressure spring generating the spring force to bias the first pressure spring seat away from the second pressure spring seat; a spring adjustment bolt and bearing assembly disposed within the stud bearing housing and having one end abutting the second pressure spring seat, the spring adjustment bolt and bearing assembly allows axial translation of the preload stud extending therethrough; a spring adjustment nut abutting an opposite side of the spring adjustment bolt and bearing assembly, the spring adjustment nut threadably engaged with threads on the first end of the preload stud; a mounting ring portion having the exposed first end of the preload stud extending therefrom; and a seal being substantially cylindrical shape and flexible at least along a central axis thereof, the seal having a first end sealably secured to the journal spring adjusting bolt and bearing assembly and an opposite second end sealably secured to the mounting ring portion.

According to yet the other aspects illustrated herein, a method of retrofitting a seal for a mechanical coiled spring assembly is disclosed. The method includes: removing an extension cap from a first end of the coil spring assembly to expose a first end of a preload stud and spring adjusting nut of the coil spring assembly; removing an existing seal from a journal spring adjusting bolt and bearing assembly of the coil spring assembly; installing a mounting ring over a portion of the exposed first end of the preload stud; installing a substantially cylindrical shaped seal being flexible at least along a central axis thereof over the spring adjustment bolt and bearing assembly, the spring adjusting nut and the mounting ring; sealably securing a first end of the seal to the spring adjustment bolt and bearing assembly; and sealably securing an opposite second end of the seal to the mounting ring.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 1:
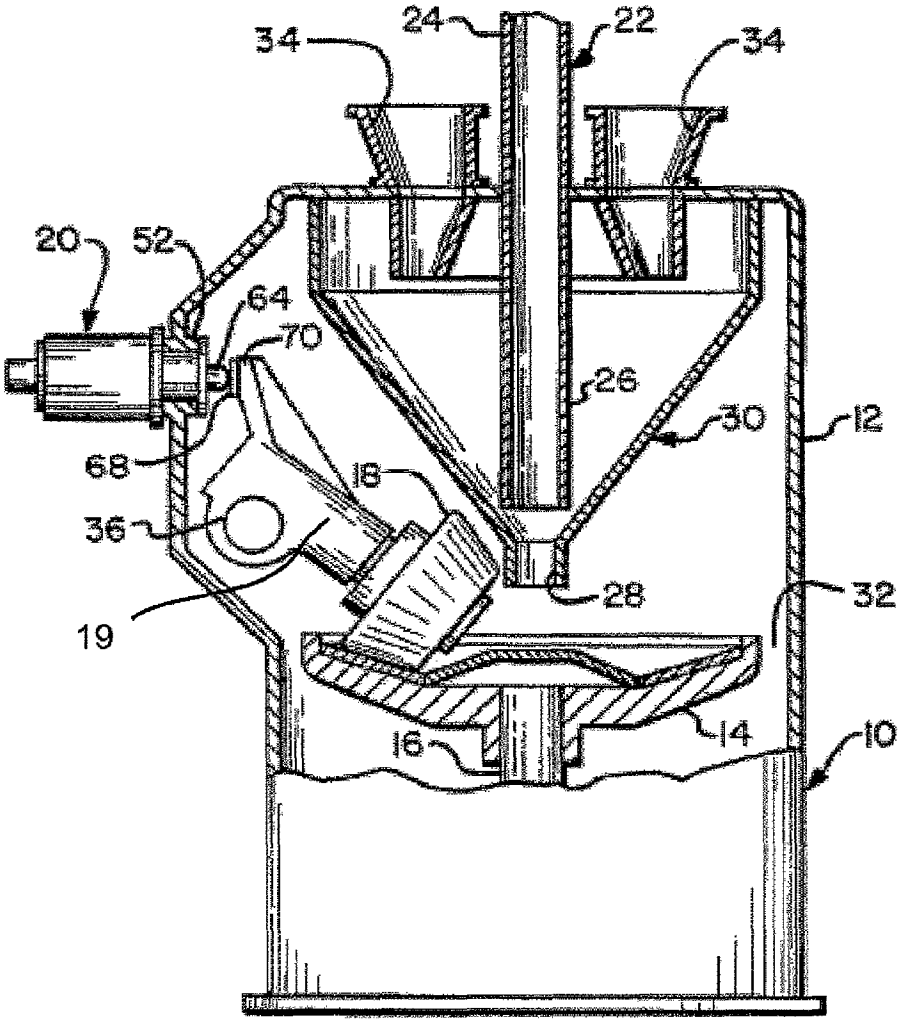
Fig. 1 (Prior Art)
FIG. 1 is a side elevational view partially in section of a pulverizer bowl mill equipped with a mechanical coiled spring assembly constructed in accordance with the prior art.

Referring now to the drawings, and more particularly to FIG. 1, a pulverizing bowl mill 10 constructed in accordance with the prior art is illustrated. As the nature of the construction and the mode of operation of pulverizing bowl mills are well-known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of a pulverizing bowl mill 10, which is equipped with a mechanical coiled spring journal loading system constructed in accordance with the present invention, that merely a description of the nature of the construction and the mode of operation of the components of the pulverizing bowl mill 10 with which the mechanical coiled spring journal loading system cooperates. For a more detailed description of the nature of the construction and the mode of operation of the components of the pulverizing bowl mill 10, which are not described in detail herein, reference is made to the prior art, e.g., U.S. Pat. No. 3,465,971, which issued on Sep. 9, 1969 to J. F. Dalenberg et al., and/or U.S. Pat. No. 4,002,299, which issued on Jan. 11, 1977 to C. J. Skalka.

Still referring to FIG. 1, the pulverizing bowl mill 10 includes a substantially closed separator body 12. A grinding table 14 is mounted on a shaft 16, which in turn is operatively connected to a suitable drive mechanism (not shown) so as to be capable of being suitably driven thereby. With the aforesaid components arranged within the separator body 12 in the manner depicted in FIG. 1 of the drawing, the grinding table 14 is designed to be driven in a clockwise direction.

A plurality of grinding rolls 18, preferably three in number in accord with conventional practice, are suitably supported within the interior of the separator body 12 so as to be equidistantly spaced one from another around the circumference of the separator body 12. In the interest of maintaining clarity of illustration in the drawing, only one grinding roll 18 is shown in FIG. 1. Each of the grinding rolls 18 is supported on a suitable shaft (not shown) of a journal assembly 19 for rotation relative thereto. The grinding rolls 18 are each suitably supported in a manner for movement relative to the upper surface, as viewed with reference to FIG. 1, of the grinding table 14. To this end, each of the grinding rolls 18 has a mechanical coiled spring system 20, cooperatively associated therewith via the journal assembly 19. Each of the mechanical coiled spring systems 20 is operative to establish a mechanical spring loading on the corresponding grinding roll 18 to exert the requisite degree of force on the solid fuel disposed on the grinding table 14 for the desired purpose of pulverizing the solid fuel.

The solid fuel material, e.g., coal, which is pulverized in the bowl mill 10 is fed thereto through the use of any suitable conventional type of feeding means such as a belt feeder (not shown). Upon falling free of the belt feeder (not shown), the coal enters the bowl mill 10 from a coal supply means, generally designated by reference numeral 22. The coal supply means 22 includes a suitably dimensioned duct 24 having one end thereof which extends outwardly of the separator body 12 and preferably terminates in a funnel-like member (not shown). The latter funnel-like member (not shown) is shaped to facilitate the collection of the coal particles leaving the belt feeder (not shown), and to guide the coal particles into the duct 24. The other end 26 of the duct 24 of the coal supply means 22 is operative to effect the discharge of the coal onto the surface of the grinding table 14. As shown in FIG. 1, the duct end 26 is supported within the separator body 12 such that the duct end 26 is coaxially aligned with the shaft 16, and is located in spaced relation to an outlet 28 provided in a classifier 30, through which the coal flows in the course of being fed onto the surface of the grinding table 14.

A gas such as air is used to convey the finer ground coal from the grinding table 14 through the interior of the separator body 12 for discharge from the pulverizing bowl mill 10. The air enters the separator body 12 through a suitable opening (not shown) provided therein for this purpose. The air flows to a plurality of annular spaces 32 from the aforesaid opening (not shown) in the separator body 12. The plurality of annular spaces 32 are formed between the circumference of the grinding table 14 and the inner wall surface of the separator body 12. The air upon exiting from the annular spaces 32 is deflected over the grinding table 14 by means of suitably positioned deflector means (not shown). One such form of deflector means (not shown), which is suitable for this purpose in the bowl mill 10 of FIG. 1, comprises the subject matter of U. S. Pat. No. 4,234,132, which issued on Nov. 18, 1980 to T. V. Maliszewski, Jr., and which is assigned to the same assignee as the present application.

While the air is flowing along the path described above, the coal disposed on the surface of the grinding table 14 is pulverized by the grinding rolls 18. As the coal becomes pulverized, the particles are thrown outwardly by centrifugal force away from the center of the grinding table 14. Upon reaching the peripheral circumferential area of the grinding table 14, the coal particles are picked up by the air exiting from the annular spaces 32 and are carried along therewith. The combined flow of air and coal particles is thereafter captured by the deflector means (not shown). The deflector means causes the combined flow of air and coal particles to be deflected over the grinding table 14. In the course of effecting a change in direction in the path of flow of this combined stream of air and coal particles to be deflected over the grinding table 14, the heaviest coal particles, because they have more inertia, become separated from the airstream and fall back onto the grinding table 14 whereupon they undergo further pulverization. The lighter coal particles, on the other hand, because they have less inertia continue to be carried along in the airstream.

After leaving the influence of the aforesaid deflector means (not shown) the combined stream of air and remaining coal particles flow to the classifier 30. The classifier 30, in accord with conventional practice and well-known to those skilled in the art, further sorts the coal particles that remain in the airstream. Namely, those particles of pulverized coal, which are of the desired particle size, pass through the classifier 30 and along with the air are discharged from the bowl mill 10 through the outlets 34. However, the coal particles having a size larger than desired are returned to the surface of the grinding table 14 whereupon they undergo further pulverization. Thereafter, these coal particles are subject to repetition of the process described above. That is, the particles are thrown radially outwardly of the grinding table 14, are picked up by the air exiting from the annular spaces 32, are carried along with the air to the deflector means (not shown), are deflected back over the grinding table 14 by the deflector means (not shown), the heavier particles drop back on the grinding table 14, the lighter particles are carried along to the classifier 30, those particles which are of the proper size pass through the classifier 30 and exit from the bowl mill 10 through the outlets 34.

The amount of force that must be exerted by the grinding rolls 18 in order to effect the desired degree of pulverization of the coal will vary depending on a number of factors. In other words, the amount of force that the grinding rolls 18 must exert in order to accomplish the desired pulverization of the coal is principally a function of the amount, e.g., depth, of coal present on the grinding table 14. In turn, the amount of coal which is disposed on the grinding table 14 is a function of the output rate at which the bowl mill 10 is being operated to produce pulverized coal.

The amount of grinding force which the grinding rolls 18 apply to the coal on the grinding table 14 is a function of the amount of force with which the grinding rolls 18 are biased into engagement with the coal on the table 14. The grinding roll 18 is supported so as to be pivotable about a pivot pin 36 into and out of engagement with the coal disposed on the grinding table 14. Although only one grinding roll 18 is shown in FIG. 1 and although this discussion is directed to one grinding roll 18, it is to be understood that the bowl mill 10 commonly is provided with a plurality of grinding rolls 18, e.g., preferably three in number, and that this discussion is equally applicable to each of the plurality of grinding rolls 18.

The grinding roll 18 is designed to be biased by a spring force into and out of engagement with the coal on the grinding table 14. More specifically, the spring force applied to the grinding roll 18 is applied by the mechanical coiled spring system 20. To this end, the bowl mill 10 embodies a plurality of new and improved mechanical coiled spring assemblies 200, as partially illustrated in FIG. 4. That is, in accord with the best mode embodiment of the invention each of the three grinding rolls 18 with which the bowl mill 10 is provided has cooperatively associated therewith a new and improved mechanical coiled spring system 200. However, inasmuch as the three mechanical coiled spring systems 200 are each identical in construction and in mode of operation, it has been deemed sufficient for purposes of obtaining an understanding thereof as well as in the interest of maintaining clarity of illustration in the drawing to show only one of the three mechanical coiled spring systems 200 in FIG. 4.

Turning now to consideration in further detail of the nature of the construction of the mechanical coiled spring system 200 of FIG. 4, general reference will be made first to FIGS. 2 and 3 for this purpose in describing the conventional mechanical coiled spring system 20 of FIG. 1. As depicted therein, the mechanical coiled spring system 20 includes the following major components: a stud bearing housing 37; a spring preload stud 38; pressure springs 39 and 40; a spring housing 42; and an extension cap 44.

Figure 2:
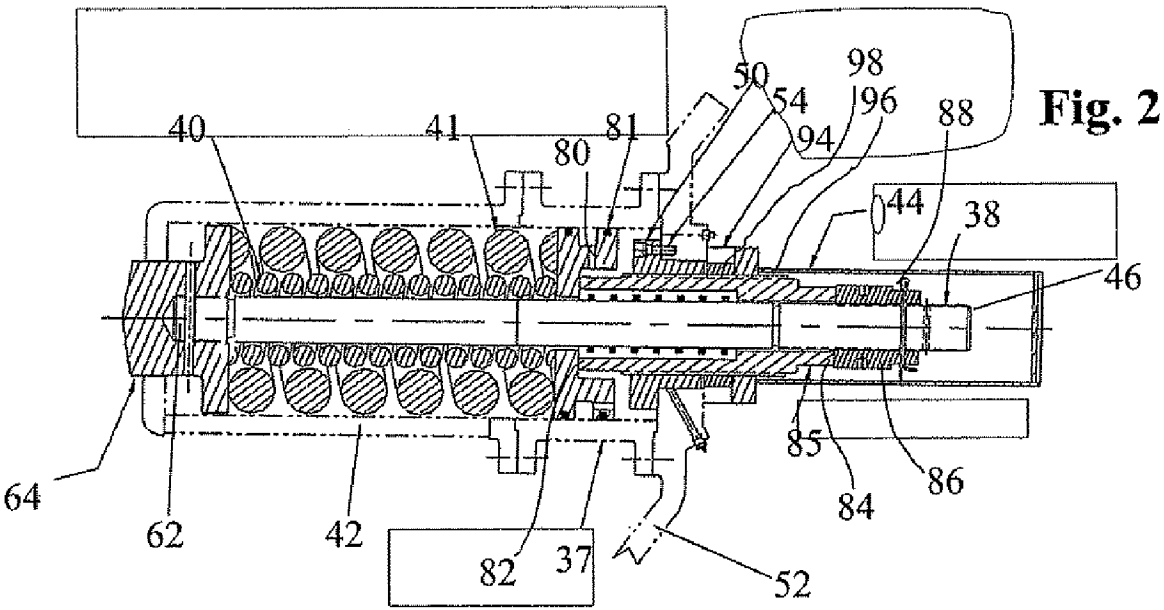
Fig. 2 (Prior Art)
FIG. 2 is an enlarged cross-sectional view of the mechanical coiled spring assembly of the pulverizer bowl mill of FIG. 1 constructed in accordance with the prior art.
Figure 3:
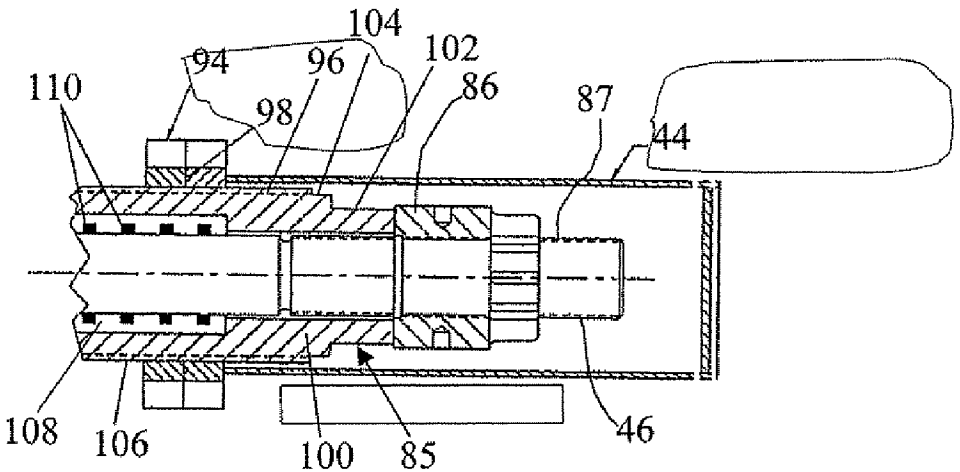
Fig. 3 (Prior Art)
FIG. 3 is an enlarged partial cross-sectional view of the mechanical coiled spring assembly of FIG. 2 constructed in accordance with the prior art and with a cotter pin removed from an adjusting castle nut.

Referring to FIGS. 2 and 3, the spring preload stud 38 is configured to extend substantially the entire length of the mechanical coiled spring system 20. Moreover, a first end 46 of the spring preload stud 38 extends from one end of the mechanical coiled spring system 20 and is covered by the extension cap 44. With the first end 46 of the spring preload stud 38 positioned within the mechanical coiled spring system 20 in the manner depicted in FIG. 2, the first end 46 of the spring preload stud 38 is designed to protrude outwardly of the mechanical coiled spring system 20 to be visually inspected when the extension cap 44 is removed.

The mounting as shown in FIG. 2 of the spring preload stud 38 within the mechanical coiled spring system 20 is accomplished through the operation of the stud bearing housing 37. The stud bearing housing 37 is positioned relative to the spring preload stud 38 so as to encircle a spring adjust bolt bushing 50 interposed between the outer surface of an intermediate portion of the spring preload stud 38 and the inner surface of the stud bearing housing 37. The spring adjust bolt bushing 50 in turn is fastened to the journal opening cover 52 of the bowl mill 10 through the use of any suitable form of conventional fastening means such as threaded fasteners, one of which can be seen depicted at 54 in FIG. 2.

A second end 62 of the spring preload stud 38 is configured so as to receive a first pressure spring seat 64. The first pressure spring seat 64 is designed to interact with the pressure springs 39 and 40 on one side and is configured with on an opposite side to interact with the journal head 70 of the bowl mill 10 (see FIG. 1).

Still referring to FIG. 2, the pressure springs 40 and 41 are inner and outer coil springs, respectively, in which each encircle the spring preload stud 38. In addition, one end of each of the pressure springs 40 and 41 abut against a second pressure spring seat 80 having at least one piston ring 81 (two shown in FIG. 2). The second pressure spring seat 80 is configured having the spring preload stud 38 to extend therethrough and abut a first end 82 extending from a spring adjust bolt and bearing assembly 85. A second opposite end 84 extending from the spring adjust bolt and bearing assembly 85 abuts a spring adjusting nut 86 threadably engaged with threads 87 on the second end 46 of the spring preload stud 38. As illustrated in FIG. 2, for example, but is not limited thereto, the spring adjusting nut 86 is a castle nut having a cotter pin 88 extending therethrough and through the preload stud 38 to prevent axial translation relative to each another. The other end of the journal pressure springs 40 and 41 abut against the first pressure spring seat 64 as discussed above.

The journal pressure springs 40 and 41 are housed within the spring housing 42. The stud bearing housing 37 is positioned intermediate the journal opening cover 52 and the right-hand end of the spring housing 42, as illustrated in FIG. 2. Furthermore, the stud bearing housing 37 is preferably both pinned and fastened to the journal opening cover 52. That is, by means of a dowel pin (not shown), the stud bearing housing 37 is pinned to the journal opening cover 52, whereas through the use of any suitable form of conventional fastening means such as threaded fasteners, the stud bearing housing 37 is fastened to the journal opening cover 52. Any suitable form of conventional fastening means can also be used for purposes of securing the right-hand end, as viewed with reference to FIG. 2, of the spring housing 42 to the stud bearing housing 37 such as threaded fasteners (not shown).

As best seen with reference to FIG. 2, the spring adjustment bolt and bearing assembly 85 is associated with the spring adjust bolt bushing 50. The spring adjustment bolt and bearing assembly 85 is threadably engaged with the spring adjust bolt bushing 50 allowing translation of the spring adjustment bolt and bearing assembly 85 relative to the spring adjust bolt bushing 50 fixed to the journal opening cover 52. In this manner, the spring adjustment bolt and bearing assembly 85 can position the second pressure spring seat 80 which will in turn translate the first spring seat 64, via connection to springs 40 and 41, to provide a desired pivotal movement of the journal assembly 19 (FIG. 1). Namely, rotation of the spring adjustment bolt and bearing assembly 85 is transmitted to the second pressure spring seat 80 and therethrough to the journal pressure springs 40 and 41 whereby as the grinding roll 18 wears, engagement is maintained as required between the spring stud insert 64 and the journal head insert 68 (see FIG. 1). That is, as the grinding roll 18 wears the journal pressure springs 40 and 41 must be made to move closer to the journal head 70.

A spring bolt locknut 94 is threadably engaged with corresponding threads on a first outside diameter 96 of the spring adjustment bolt and bearing assembly 85 to prevent further translation thereof once the desired position is selected. More specifically, the spring bolt locknut 94 is suitably located relative to the journal opening cover 52 so as to be in abutting engagement therewith.

As best understood with reference to FIGS. 2 and 3, an O-ring 98 is cooperatively associated with the spring bolt locknut 94. Finally, the spring bolt locknut 94 and the other components associated therewith which have been enumerated above are all housed within the stud extension cap 44.

Referring to FIG. 3 in particular, the spring adjustment bolt and bearing assembly 85 includes a spring adjustment bolt 100 having the threaded first outside diameter 96 and a second outside diameter 102 smaller than the first outside diameter 96. The second outside diameter 102 is not threaded and corresponds to a terminal end of the spring adjustment bolt 100 abutting the locknut 86. A third outside diameter 104 smaller than the first outside diameter and larger than the second diameter 102 is interposed therebetween and defines a shoulder between the first and second outside diameters 96, 102 of the spring adjustment bolt 100. The spring bolt locknut 94 is threadably engaged with corresponding threads 106 on the first outside diameter 96 of the spring adjustment bolt 100 to axially lock the spring adjustment bolt and bearing assembly 85 with respect to the spring adjust bolt bushing 50 fixed to the journal opening cover 52 and prevent further translation thereof once the desired axial position is selected. An inside diameter defining the spring adjustment bolt 100 includes a bushing 108 impregnated with a plurality of spaced apart long-wearing seals 110 (seven shown in FIG. 2) along an axial length defining an inside diameter of the bushing 108. The bushing 108 is made of bronze impregnated with long-wearing graphite as the seals 110 forming a seal with the spring preload stud 38 while allowing the spring preload stud 38 to be axially translatable therethrough.

Figure 4:
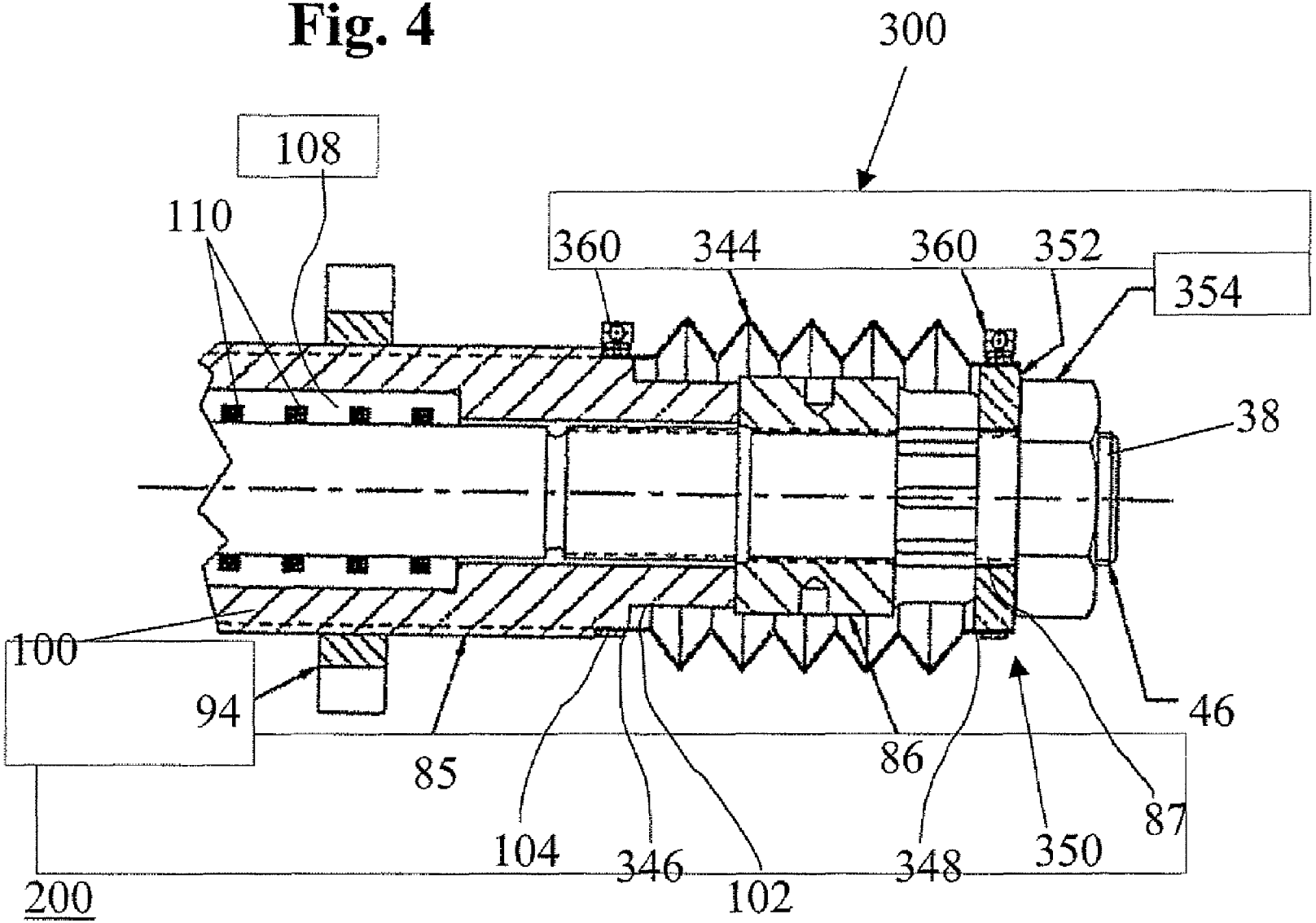
FIG. 4 is an enlarged partial cross-sectional view of an exemplary embodiment of a mechanical coiled spring assembly having an exemplary seal allowing a spring stud to extend therethrough in accordance with the present invention.
Figure 2:
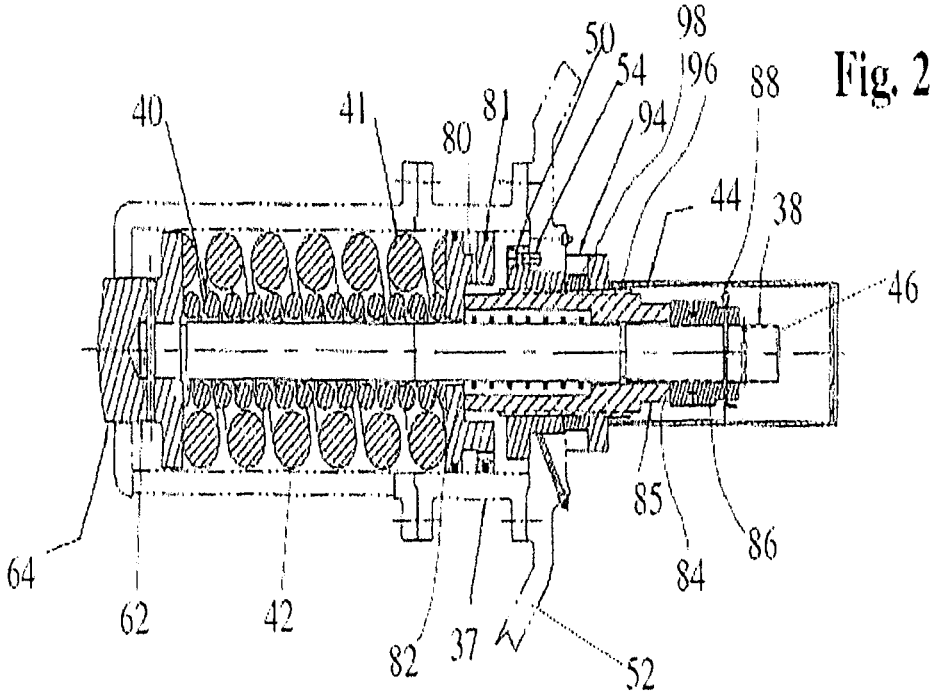
Fig. 2 (Prior Art)
Figure 3:
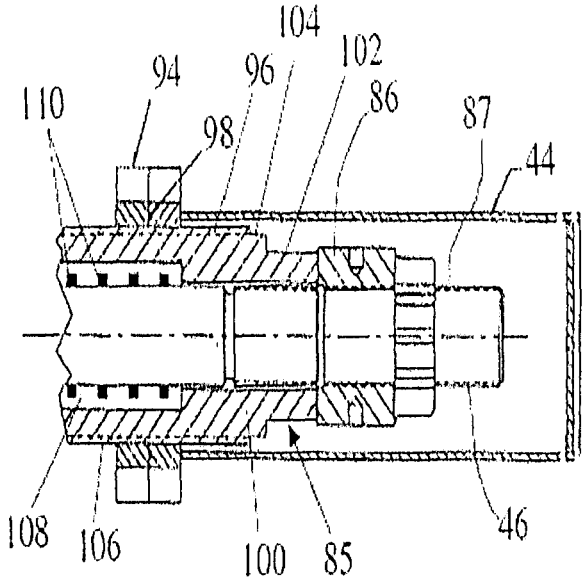
Fig. 3 (Prior Art)
Figure 4:
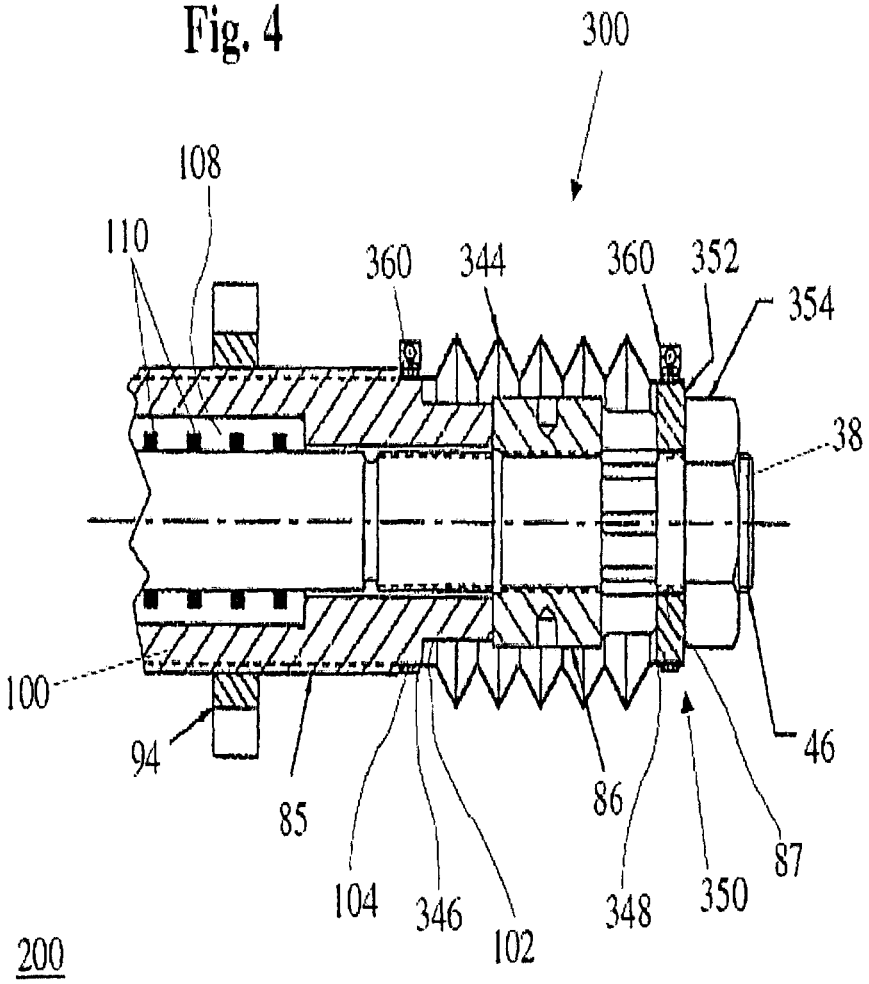

FIG. 4 illustrates an exemplary embodiment of a seal assembly 300 for a mechanical coiled spring assembly 200 which allows visually inspection of the first end 46 of the preload stud 38 at all times, including during operation of a bowl mill to which it is associated while maintaining a positive seal at the end of the coil spring assembly 200, in accordance with the present invention. In particular, it will be recognized that FIG. 4 is a partial cross-sectional view of FIG. 3 with the O-ring 98, cotter pin 88 and extension cap 44 removed from the mechanical coiled spring assembly 200 of FIG. 4.

FIG. 4 illustrates the seal assembly 300 including a seal 344 which is substantially cylindrical shaped and flexible at least along a central axis thereof and corresponding to an axis defined by the preload stud 38. The seal 344 includes a first end 346 operably secured to the spring adjustment bolt and bearing assembly 85 and an opposite second end 348 operably secured to the second end 46 of the preload stud 38 thereby sealing the bushing 108 corresponding to a portion of the preload stud 38 surrounded by the spring adjustment bolt and bearing assembly 85 from ground solid fuel dust and allowing movement of the preload stud 38 at least along the central axis thereof to apply the spring force from the coil spring assembly 200 to the grinding roll 18 (FIG. 1). As described with reference to FIGS. 2 and 3 above, the spring adjustment nut 86 abuts the spring adjustment bolt 100 of the spring adjustment and bearing assembly 85 by being threadably engaged with threads 87 on the second end 46 of the preload stud 38 extending therethrough. The second end 348 of the seal 344 is mounted to a mounting ring portion 350 having the second end 46 of the preload stud 38 extending therefrom.

In an exemplary embodiment as illustrated in FIG. 4, the mounting ring portion 350 is an independent mounting ring 352 slidably disposed over a portion of the exposed second end 46 of the preload stud 38. Further, the mounting ring 352 is configured having an outside diameter substantially the same as an outside diameter corresponding to the third outside diameter 104 of the spring adjustment bolt and bearing assembly 85 to which the seal 344 is secured. In alternative exemplary embodiments, the mounting ring portion 350 may be integral with the spring adjusting nut 86. For example, the spring adjusting nut 86 may include the flats of the nut configured having a cylindrical outside diameter to circumferentially clamp the second end 348 of the seal 344 thereto.

The seal assembly 300 further includes a nut 354 threadably engaged on corresponding threads 87 on a remaining portion of the exposed second end 46 of the preload stud 38 abutting the mounting ring 352 to secure the mounting ring 352 to the preload stud 38. In exemplary embodiments, the nut 354 is a hex jam nut installed on the corresponding threads 87 on end 46 of the exposed spring preload stud 38.

In exemplary embodiments of the seal assembly 300, the seal 344 is flexible allowing relative motion of the preload stud 38 in axial, radial and angular directions, while exposing a terminal end of end 46 of the preload stud 38 and maintaining a positive seal to prevent solid fuel dust (e.g., coal dust) as a result of pulverization from entering a bushing area corresponding to the bushing 108 and a portion of the preload stud 38 surrounded thereby. In an exemplary embodiment as illustrated in FIG. 4, the positive seal is maintained using a bellows type seal 344 with a clamp circumferentially around each of the first and second ends 346, 348 of the seal 348. The bellows seal 344 allows for a high amount of relative motion (e.g., axial, radial, and angular) between the spring preload stud 38 and the remainder of the coil spring assembly 200 while still providing a positive seal. In the prior art, internal lip type seals have been used to seal against the spring stud, but the internal lip type seals experienced excessive wear and were not capable of withstanding the relative motion of the spring preload stud and coil spring assembly.

It will be recognized, by those skilled in the pertinent art that the above described bellows seal 344 may be configured for different sizes and types of journal spring assemblies, both existing and new, but the same design concept will be consistent. In exemplary embodiments, the bellows seal 344 is made of a polymer such as nitrile or neoprene as well as plastics or other suitable sealing materials (e.g., rubber, a reinforced rubber, silicon, plastic, or any other suitably flexible material). Any suitable natural rubber or synthetic polymer may be employed; neoprene rubber, polyurethanes, styrene/butadiene rubbers, nitrile elastomers, and silicone resins might be mentioned as typical, but the selection of a suitable material for any given application will be evident to those skilled in the art. In addition to providing the requisite flexibility, resiliency and durability under the variety of conditions to which the seal might be exposed, the material from which the seal is formed must be capable of forming a seal with the preload stud and spring bolt and bearing assembly, both composed of metal. For example, one exemplary embodiment of a bellows type seal is comprised of a nylon reinforced neoprene rubber. Although a clamp has been described above to maintain such a seal with respect to the preload stud and spring bolt and bearing assembly, the seal may be promoted by the use of an adhesive, a bonding agent, a chemical surface activator, or the like (the choice of which will also be evident to those skilled in the art), as well as by roughening of the surface of the component to which the rubber is to be bonded (e.g., by sand-blasting or the equivalent), or by other means.

Referring to FIGS. 3 and 4, it will be recognized by those skilled in the pertinent art that mechanical coiled spring assembly 200 of FIG. 4 may be obtained by retrofitting the mechanical coiled spring assembly 20 of FIG. 3 while maintaining as many original parts as possible. More specifically, it will be noticed that in order to retrofit the mechanical coiled spring assembly 20 of FIG. 3, the extension cap 44 and O-ring 98 are first removed.

In particular still referring to FIGS. 3 and 4, a method of retrofitting a seal for a mechanical coiled spring assembly first includes removing the extension cap 44 from a first end of the coil spring assembly to expose the first end 46 of the preload stud 38 and spring adjusting nut 86 of the coil spring assembly. Next, the existing O-ring seal 98 is removed from the spring adjusting bolt and bearing assembly 85.

The mounting ring 352 is then installed over a portion of the exposed first end 46 of the preload stud 38 and the substantially cylindrical shaped and flexible seal 344 is installed over the spring adjustment bolt and bearing assembly 85, the spring adjusting nut 86 and the mounting ring 352. The seal 344 is flexible at least along a central axis thereof. In exemplary embodiments as discussed above, the seal is a bellows type seal, as illustrated in FIG. 4, and is thus flexible allowing relative motion of the preload stud 38 in axial, radial and angular directions with respect to the remaining spring coil assembly, while maintaining a positive seal.

Referring to FIG. 4, the first end 346 of the seal 344 is sealably secured to the third outside diameter 104 of the spring adjustment bolt 100. The opposite second end 348 of the seal 344 is sealably secured to the mounting ring 352. As discussed, a bellows clamp is used at each of the ends 346, 348 for sealable securement with the third outside diameter 104 of the spring adjustment bolt 100 and the mounting ring 352, respectively. The exemplary method further includes threadably engaging the nut 354 on corresponding threads 87 on a remaining portion of the exposed first end 46 of the preload stud 38 to secure the mounting ring 352 to the preload stud 38.

There will now be set forth a description of the mode of operation of the mechanical coiled spring system 200, which forms the subject matter of the present invention, in the context of the operation of the bowl mill 10 of FIG. 1. For this purpose, reference will be had in particular to FIGS. 1 and 4. The mechanical coiled spring system 200 of FIG. 4 is suitably mounted on the exterior wall surface of the separator body 12, and in particular on the journal opening cover 52 of FIG. 1 in a same manner that the coil spring system 20 of FIGS. 1-3. Within the mechanical coiled spring system 200, the journal pressure springs 40 and 41, as has been described in detail hereinbefore is suitably supported for expansion and contraction therewithin. However, a single spring or more than two springs (e.g., may or may not be concentric with one another) or other biasing member other than a mechanical coiled spring is contemplated in alternative exemplary embodiments. Cooperatively associated with the journal pressure springs 40 and 41 is the spring stud insert 64, which projects outwardly of the mechanical coiled spring system 200. The spring stud insert 64 engages the journal head insert 68, which is suitably affixed to the journal head 70. The journal head 70 in turn comprises a portion of the support means for the grinding roll 18. In a manner well-known to those skilled in the spring biasing art, the journal pressure springs 40 and 41 through the spring stud insert 64 exert a spring biasing force on the journal head insert 68 and thereby to the journal head 70.

Accordingly, the engagement of the spring stud insert 64 with the journal head insert 68 and thereby the journal head 70 is a function of the force being exerted by the journal pressure springs 40 and 41. In turn, the extent to which the spring stud insert 64 is biased into engagement with the journal head insert 68 and thereby with the journal head 70 by the journal pressure springs 40 and 41 determines the extent to which the grinding roll 18 is spring biased into engagement with the coal on the grinding table 14, and concomitantly the amount of grinding force being applied to the coal by the grinding roll 18.

By way of exemplification and referring to FIG. 1, as the coal builds up on the grinding table 14, i.e., under the grinding roll 18, the journal head 70 rotates in a counterclockwise direction about the pivot pin 36 which results in an increase in the spring force that is exerted by the mechanical coiled spring system 20. Conversely, when the grinding roll 18 and/or grinding table 14 wears, the journal head 70 rotates in a clockwise direction about the pivot pin 36 which results in a decrease in the spring force that is exerted by the mechanical coiled spring system 200. However, unlike the conventional mechanical spring system illustrated in FIGS. 1-3 in which the extension cap 44 must be removed to allow inspection of the first end 46 of the preload stud 38 to determine the amount of spring movement indicative of movement of the journal head 70 and grinding roll 18, the seal assembly 300 of FIG. 4 allows visual inspection of first end 46 of the preload stud 38 to determine the amount of spring movement indicative of movement of the journal head 70 and grinding roll 18.

The seal assembly 300 of FIG. 4, in accordance with exemplary embodiments of the present invention, allows visual inspection of an end of the preload stud exposed to atmospheric pressure without having to remove a cap for visual inspection thereof and maintains a positive seal across the coil spring assembly to effectively eliminate a differential pressure while allowing the preload stud to translate at least along a central axis thereof with respect to the fixed coiled spring assembly. In this manner, the end of the preload stud may be monitored at all times and solid fuel dust, such as coal dust, for example, can be effectively prevented from penetrating into the assembly. Lastly, exemplary embodiments of the seal assembly in accordance with the present invention permit the mechanical coiled spring assembly 200 of FIG. 4 to be obtained by retrofitting the mechanical coiled spring assembly 20 of FIGS. 2 and 3 while maintaining as many original parts as possible.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mill for pulverizing a solid fuel, the mill comprising:

a substantially closed separator body;

a grinding table rotatably mounted on a shaft in the separator body;

a grinding roll rotable via a journal assembly disposed in the separator body, the journal assembly being supported so as to be pivotable and move the grinding roll into and out of engagement with solid fuel disposed on the grinding table;

a coil spring assembly connected to the separator body and in communication with the journal assembly to apply a spring force to the grinding roll, the coil spring assembly including:

a preload stud having a first end in communication with the journal assembly and an opposite second end extending from the coil spring assembly and exposed outside of the separator body;

a spring adjustment bolt and bearing assembly being fixed relative to the preload stud extending therethrough; and a seal being substantially cylindrical shaped and flexible at least along a central axis thereof, the seal having a first end operably secured to the spring adjustment bolt and bearing assembly and an opposite second end operably secured to the second end of the preload stud thereby sealing a bushing area corresponding to a portion of the preload stud surrounded by the spring adjustment bolt and bearing assembly from ground solid fuel dust and allowing movement of the preload stud at least along the central axis thereof to apply the spring force from the coil spring assembly to the grinding roll.

2. The mill of claim 1, further comprising:

a spring adjustment nut abutting the spring adjustment bolt and bearing assembly, the spring adjustment nut threadably engaged with threads on the second end of the preload stud extending therethrough; and a mounting ring portion having the second end of the preload stud extending therefrom.

3. The mill of claim 2, wherein the mounting ring portion is an independent mounting ring slidably disposed over a portion of the exposed second end of the preload stud, the mounting ring having an outside diameter substantially the same as an outside diameter of the spring adjustment bolt and bearing assembly to which the seal is secured.

4. The mill of claim 3, further comprising a nut threadably engaged on corresponding threads on a remaining portion of the exposed second end of the preload stud to secure the mounting ring to the preload stud, and a clamp circumferentially around each of the first and second ends of the seal.

5. The mill of claim 3, wherein the mounting ring portion is integral with the spring adjusting nut.

6. The mill of claim 1, wherein the seal is flexible allowing relative motion of the preload stud in axial, radial and angular directions, while maintaining a positive seal.

7. The mill of claim 1, wherein the seal is a bellows type seal.

* * * * *

UNITED STATES PATENT AND TRADEMARK OFFICE

CERTIFICATE OF CORRECTION

PATENT NO. : 7,584,917 B2
APPLICATION NO. : 11/693052
DATED : September 8, 2009
INVENTOR(S) : Oliver G. Briggs et al.

It is certified that error appears in the above-identified patent and that said Letters Patent is hereby corrected as shown below:

The Title Page, showing an illustrative Figure, should be deleted and substitute therefor the attached title page.

Please replace Figure 2, 3 and 4 with attached drawing sheets. Marking done around reference numerals deleted.

In column 2, line 48, delete "rotable" and insert -- rotatable --, therefor.

In column 12, line 1, in Claim 1, delete "rotable" and insert -- rotatable --, therefor.

Signed and Sealed this

Twenty-fifth Day of May, 2010

David J. Kappos

David J. Kappos
*Director of the United States Patent and Trademark Office*

(12) United States Patent
Briggs et al.

(10) Patent No.: US 7,584,917 B2
(45) Date of Patent: Sep. 8, 2009

(54) SEAL FOR COILED SPRING ASSEMBLY

(75) Inventors: Oliver G. Briggs, Jefferson, MA (US); Jeffrey A. Case, East Granby, CT (US); Melissa Cassidy, Newington, CT (US); Lawrence S. Farris, East Granby, CT (US)

(73) Assignee: Alstom Technology Ltd (CH)

( * ) Notice: Subject to any disclaimer, the term of this patent is extended or adjusted under 35 U.S.C. 154(b) by 218 days.

(21) Appl. No.: 11/693,052

(22) Filed: Mar. 29, 2007

(65) Prior Publication Data

US 2008/0237379 A1 Oct. 2, 2008

(51) Int. Cl.
*B02C 15/00* (2006.01)

(52) U.S. Cl. ..... 241/121

(58) Field of Classification Search ..... 241/117–121, 241/293

See application file for complete search history.

(56) References Cited

U.S. PATENT DOCUMENTS 3,465,971 A 9/1969 Dalenberg et al.
4,002,299 A 1/1977 Skalka
4,234,132 A 11/1980 Maliszewski, Jr.
4,706,900 A 11/1987 Prairie et al.
4,759,509 A 7/1988 Prairie
6,061,908 A 5/2000 DeMarey et al.
6,564,727 B1 5/2003 Kmiotek et al.

*Primary Examiner*—Mark Rosenbaum
(74) *Attorney, Agent, or Firm*—Cantor Colburn LLP

(57) ABSTRACT

A coil spring assembly for connection with a separator body to apply a spring force to a grinding roll of a journal assembly to pulverize solid fuel. The coil spring assembly includes: a preload stud having a first end in communication with the journal assembly and an exposed opposite second end extending from the coil spring assembly; a spring adjustment bolt and bearing assembly being fixed relative to the preload stud extending therethrough; and a seal being substantially cylindrical shaped and flexible at least along a central axis thereof. The seal has a first end operably secured to the spring adjustment bolt and bearing assembly and an opposite second end operably secured to the second end of the preload stud thereby sealing a bushing area corresponding to a portion of the preload stud surrounded by the spring adjustment bolt and bearing assembly from ground solid fuel dust and allowing movement of the preload stud at least along the central axis thereof to apply the spring force from the coil spring assembly to the grinding roll.

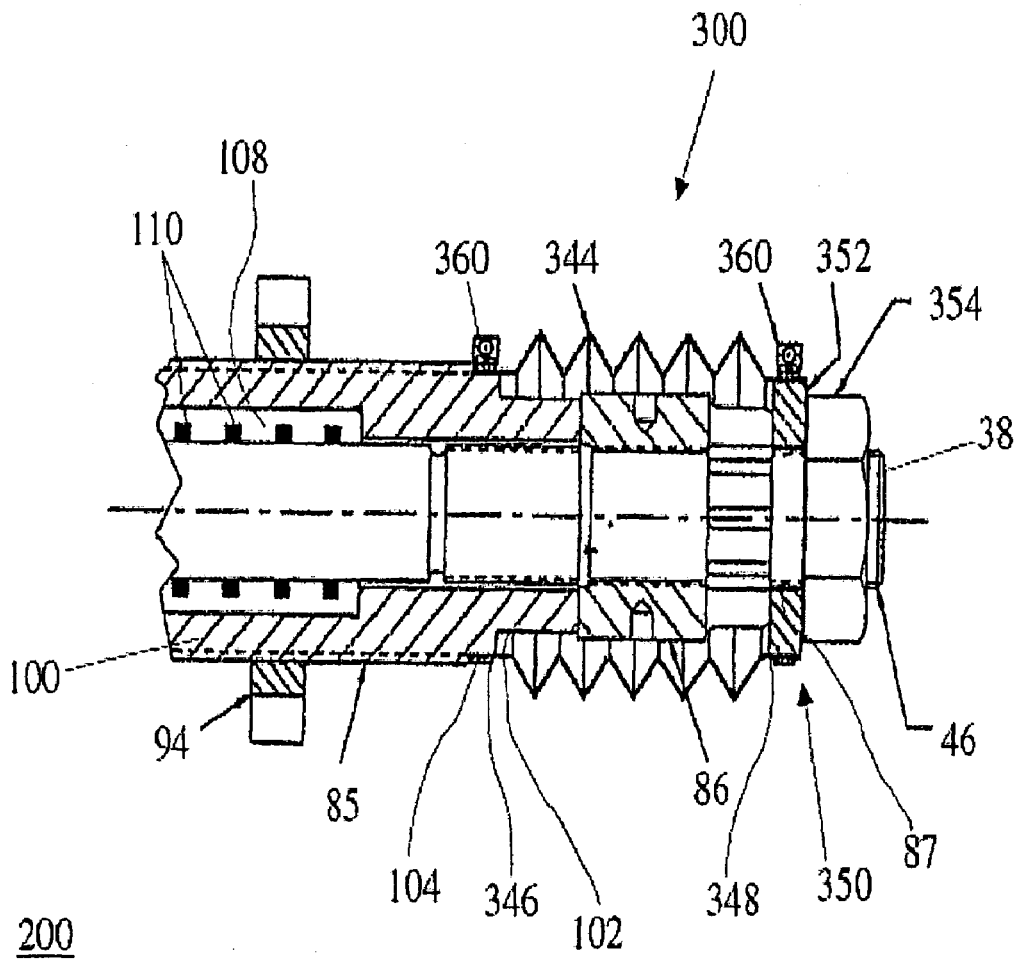

7 Claims, 3 Drawing Sheets